US008272295B2

(12) United States Patent
Smith et al.

(10) Patent No.: US 8,272,295 B2
(45) Date of Patent: Sep. 25, 2012

(54) DISPLACEMENT MEMBERS AND INTERMEDIATE STRUCTURES FOR USE IN FORMING AT LEAST A PORTION OF BIT BODIES OF EARTH-BORING ROTARY DRILL BITS

(75) Inventors: Redd H. Smith, The Woodlands, TX (US); John H. Stevens, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 1039 days.

(21) Appl. No.: 11/635,432

(22) Filed: Dec. 7, 2006

(65) Prior Publication Data

US 2008/0135305 A1 Jun. 12, 2008

(51) Int. Cl.
*B21K 5/04* (2006.01)

(52) U.S. Cl. ..... 76/108.2; 76/108.1

(58) Field of Classification Search ..... 76/108.2, 76/5.1, 108.1, 108.4, 108.6; 29/447
See application file for complete search history.

(56) References Cited

U.S. PATENT DOCUMENTS 2,324,748 A * 7/1943 Welch ..... 76/108.1
2,422,994 A * 6/1947 Taylor ..... 408/59
2,507,439 A 5/1950 Goolsbee
2,901,932 A * 9/1959 Erdelyi ..... 72/38
3,660,050 A 5/1972 Iler et al.
3,735,648 A * 5/1973 Haller ..... 76/107.4
3,757,879 A 9/1973 Wilder et al.
4,017,480 A 4/1977 Baum
4,112,769 A * 9/1978 Falk ..... 73/864.53
4,306,139 A 12/1981 Shinozaki et al.
4,389,952 A 6/1983 Dreier et al.
4,398,952 A 8/1983 Drake
4,499,958 A 2/1985 Radtke et al.
4,620,600 A 11/1986 Persson
4,743,515 A 5/1988 Fischer et al.
4,761,191 A * 8/1988 Keller et al. ..... 148/646
4,762,028 A * 8/1988 Regan ..... 76/108.2

(Continued)

FOREIGN PATENT DOCUMENTS

AU 695583 2/1998

(Continued)

OTHER PUBLICATIONS

Reed, James S., "Chapter 13: Particle Packing Characteristics," Principles of Ceramics Processing, Second Edition, John Wiley & Sons, Inc. (1995), pp. 215-227.

(Continued)

*Primary Examiner* — Hwei C Payer
(74) *Attorney, Agent, or Firm* — TraskBritt

(57) ABSTRACT

Displacement members for use in forming a bit body of an earth-boring rotary drill bit include a body having an exterior surface, at least a portion of which is configured to define at least one surface of the bit body as the bit body is formed around the displacement member. In some embodiments, the body may be hollow and/or porous. Methods for forming earth-boring rotary drill bits include positioning such a displacement member in a mold and forming a bit body around the displacement member in the mold. Additional methods include pressing a plurality of particles to form a body, forming at least one recess in the body, positioning such a displacement member in the recess, and sintering the body to form a bit body.

4 Claims, 9 Drawing Sheets

U.S. PATENT DOCUMENTS

| | | | | |
|---|---|---|---|---|
| 4,884,477 | A | 12/1989 | Smith et al. | |
| 4,889,017 | A | 12/1989 | Fuller et al. | |
| 4,919,013 | A | 4/1990 | Smith et al. | |
| 4,923,512 | A | 5/1990 | Timm et al. | |
| 4,956,012 | A | 9/1990 | Jacobs et al. | |
| 4,991,670 | A | 2/1991 | Fuller et al. | |
| 5,090,491 | A | 2/1992 | Tibbitts et al. | |
| 5,101,692 | A | 4/1992 | Simpson | |
| 5,281,260 | A | 1/1994 | Kumar et al. | |
| 5,348,806 | A | 9/1994 | Kojo et al. | |
| 5,373,907 | A | 12/1994 | Weaver | |
| 5,433,280 | A | 7/1995 | Smith | |
| 5,452,771 | A | 9/1995 | Blackman et al. | |
| 5,482,670 | A | 1/1996 | Hong | |
| 5,484,468 | A | 1/1996 | Ostlund et al. | |
| 5,518,077 | A | 5/1996 | Blackman et al. | |
| 5,543,235 | A | 8/1996 | Mirchandani et al. | |
| 5,544,550 | A | 8/1996 | Smith | |
| 5,585,313 | A * | 12/1996 | Shobu et al. | 501/89 |
| 5,593,474 | A | 1/1997 | Keshavan et al. | |
| 5,612,264 | A | 3/1997 | Nilsson et al. | |
| 5,677,042 | A | 10/1997 | Massa et al. | |
| 5,679,445 | A | 10/1997 | Massa et al. | |
| 5,697,046 | A | 12/1997 | Conley | |
| 5,725,827 | A | 3/1998 | Rhodes et al. | |
| 5,733,649 | A | 3/1998 | Kelley et al. | |
| 5,733,664 | A | 3/1998 | Kelley et al. | |
| 5,753,160 | A | 5/1998 | Takeuchi et al. | |
| 5,776,593 | A | 7/1998 | Massa et al. | |
| 5,778,301 | A | 7/1998 | Hong | |
| 5,789,686 | A | 8/1998 | Massa et al. | |
| 5,792,403 | A | 8/1998 | Massa et al. | |
| 5,806,934 | A | 9/1998 | Massa et al. | |
| 5,829,539 | A | 11/1998 | Newton et al. | |
| 5,830,256 | A | 11/1998 | Northrop et al. | |
| 5,856,626 | A | 1/1999 | Fischer et al. | |
| 5,880,382 | A | 3/1999 | Fang et al. | |
| 5,944,128 | A | 8/1999 | Truax et al. | |
| 5,957,006 | A | 9/1999 | Smith | |
| 6,045,750 | A | 4/2000 | Drake et al. | |
| 6,051,171 | A | 4/2000 | Takeuchi et al. | |
| 6,073,518 | A * | 6/2000 | Chow et al. | 76/108.2 |
| 6,086,980 | A | 7/2000 | Foster et al. | |
| 6,089,123 | A | 7/2000 | Chow et al. | |
| 6,099,664 | A | 8/2000 | Davies et al. | |
| 6,107,225 | A * | 8/2000 | Shobu et al. | 501/92 |
| 6,148,936 | A | 11/2000 | Evans et al. | |
| 6,209,420 | B1 | 4/2001 | Butcher et al. | |
| 6,214,287 | B1 | 4/2001 | Waldenstrom | |
| 6,220,117 | B1 | 4/2001 | Butcher | |
| 6,228,139 | B1 | 5/2001 | Oskarrson | |
| 6,254,658 | B1 | 7/2001 | Taniuchi et al. | |
| 6,287,360 | B1 | 9/2001 | Kembaiyan et al. | |
| 6,290,438 | B1 | 9/2001 | Papajewski | |
| 6,293,986 | B1 | 9/2001 | Rodiger et al. | |
| 6,348,110 | B1 | 2/2002 | Evans | |
| 6,454,030 | B1 | 9/2002 | Findley et al. | |
| 6,474,425 | B1 | 11/2002 | Truax et al. | |
| 6,511,265 | B1 | 1/2003 | Mirchandani et al. | |
| 6,576,182 | B1 | 6/2003 | Ravagni et al. | |
| 6,615,935 | B2 | 9/2003 | Fang et al. | |
| 6,651,756 | B1 | 11/2003 | Costo, Jr. et al. | |
| 6,655,481 | B2 | 12/2003 | Findley et al. | |
| 6,669,414 | B1 * | 12/2003 | Puide et al. | 408/144 |
| 6,685,880 | B2 | 2/2004 | Engstrom et al. | |
| 6,756,009 | B2 | 6/2004 | Sim et al. | |
| 6,833,337 | B2 * | 12/2004 | Sandhage et al. | 501/85 |
| 6,908,688 | B1 | 6/2005 | Majagi et al. | |
| 7,216,565 | B2 * | 5/2007 | Sherwood et al. | 76/108.1 |
| 7,670,979 | B2 * | 3/2010 | Quadir et al. | 501/80 |
| 7,841,259 | B2 * | 11/2010 | Smith et al. | 76/108.2 |
| 2002/0175006 | A1 * | 11/2002 | Findley et al. | 175/425 |
| 2004/0060742 | A1 | 4/2004 | Kembaiyan et al. | |
| 2004/0245022 | A1 | 12/2004 | Izaguirre et al. | |
| 2004/0245024 | A1 | 12/2004 | Kembaiyan | |
| 2005/0126334 | A1 | 6/2005 | Mirchandani | |
| 2005/0211475 | A1 | 9/2005 | Mirchandani et al. | |
| 2005/0247491 | A1 | 11/2005 | Mirchandani et al. | |
| 2006/0005900 | A1 * | 1/2006 | Dorfman | 148/400 |
| 2006/0032677 | A1 | 2/2006 | Azar et al. | |
| 2006/0043648 | A1 | 3/2006 | Takeuchi et al. | |
| 2006/0131081 | A1 | 6/2006 | Mirchandani et al. | |
| 2006/0231293 | A1 * | 10/2006 | Ladi et al. | 175/374 |
| 2007/0042217 | A1 | 2/2007 | Fang et al. | |
| 2008/0202814 | A1 * | 8/2008 | Lyons et al. | 175/61 |

FOREIGN PATENT DOCUMENTS

| | | | |
|---|---|---|---|
| CA | 2212197 | | 10/2000 |
| EP | 0169718 | B1 | 4/1989 |
| EP | 0 453 428 | A1 | 10/1991 |
| EP | 0315330 | B1 | 4/1993 |
| EP | 0790386 | A2 | 8/1997 |
| EP | 0 995 876 | A2 | 4/2000 |
| EP | 1 244 531 | B1 | 10/2002 |
| GB | 945227 | | 12/1963 |
| GB | 2296673 | A | 7/1996 |
| GB | 2 385 350 | A | 8/2003 |
| GB | 2 393 449 | A | 3/2004 |
| GB | 2425080 | A | 10/2006 |
| JP | 10 219385 | A | 8/1998 |
| WO | 9813317 | A2 | 4/1998 |
| WO | WO 03/049889 | A2 | 6/2003 |

OTHER PUBLICATIONS

U.S. Appl. No. 60/566,063, filed Apr. 28, 2004, entitled "Body Materials for Earth Boring Bits" to Mirchandani et al.

PCT International Search Report for International Application No. PCT/US2007/025099, mailed May 28, 2008.

U.S. Appl. No. 11/271,153, filed Nov. 10, 2005, entitled, "Earth-Boring Rotary Drill Bits and Methods of Forming Earth-Boring Rotary Drill Bits," to Oxford et. al.

U.S. Appl. No. 11/272,439, filed Nov. 10, 2005, entitled, "Earth-Boring Rotary Drill Bits and Methods of Manufacturing Earth-Boring Rotary Drill Bits Having Particle-Matrix Composite Bit Bodies," to Smith et al.

US 4,966,627, 10/1990, Keshavan et al. (withdrawn)

* cited by examiner

DISPLACEMENT MEMBERS AND INTERMEDIATE STRUCTURES FOR USE IN FORMING AT LEAST A PORTION OF BIT BODIES OF EARTH-BORING ROTARY DRILL BITS

FIELD OF THE INVENTION

The present invention relates to methods of forming earth-boring rotary drill bits. More particularly, the present invention relates to displacements or inserts that may be used to define topographical features on or in an earth-boring rotary drill bit, and to methods of forming earth-boring rotary drill bits using such displacements or inserts.

BACKGROUND OF THE INVENTION

Rotary drill bits are commonly used for drilling well bores in earth formations. One type of rotary drill bit is the fixed-cutter bit (often referred to as a "drag" bit), which typically includes a plurality of cutting elements secured to a face region of a bit body. The bit body of a rotary drill bit may be formed from steel. Alternatively, the bit body may be formed from a particle-matrix composite material 15. A conventional earth-boring rotary drill bit 10 is shown in FIG. 1 that includes a bit body 12 comprising a particle-matrix composite material 15. The bit body 12 is secured to a steel shank 20, which may have an American Petroleum Institute (API) or other threaded connection 28 for attaching the drill bit 10 to a drill string (not shown). The bit body 12 includes a crown 14 and a steel blank 16. The steel blank 16 is partially embedded in the crown 14. The crown 14 may include a particle-matrix composite material 15, such as, for example, particles of tungsten carbide embedded in a copper alloy matrix material. The bit body 12 is secured to the steel shank 20 by way of a threaded connection 22 and a weld 24 extending around the drill bit 10 on an exterior surface thereof along an interface between the bit body 12 and the steel shank 20.

The bit body 12 further includes wings or blades 30 that are separated by junk slots 32. Internal fluid passageways (not shown) extend between the face 18 of the bit body 12 and a longitudinal bore 40, which extends through the steel shank 20 and partially through the bit body 12. Nozzle inserts (not shown) may be provided at face 18 of the bit body 12 within the internal fluid passageways.

A plurality of cutting elements 34 are attached to the face 18 of the bit body 12. Generally, the cutting elements 34 of a fixed-cutter type drill bit have either a disk shape or a substantially cylindrical shape. A cutting surface comprising a hard, super-abrasive material, such as mutually bound particles of polycrystalline diamond, may be provided on a substantially circular end surface of each cutting element 34. Such cutting elements 34 are often referred to as "polycrystalline diamond compact" (PDC) cutting elements 34. The PDC cutting elements 34 may be provided along the blades 30 within pockets 36 formed in the face 18 of the bit body 12, and may be supported from behind by buttresses 38, which may be integrally formed with the crown 14 of the bit body 12. Typically, the cutting elements 34 are fabricated separately from the bit body 12 and secured within the pockets 36 formed in the outer surface of the bit body 12. A bonding material such as an adhesive or, more typically, a braze alloy may be used to secure the cutting elements 34 to the bit body 12.

The steel blank 16 shown in FIG. 1 is generally cylindrically tubular. Alternatively, the steel blank 16 may have a fairly complex configuration and may include external protrusions corresponding to blades 30 or other features proximate an external surface of the bit body 12.

During drilling operations, the drill bit 10 is secured to the end of a drill string, which includes tubular pipe and equipment segments coupled end to end between the drill bit 10 and other drilling equipment at the surface. The drill bit 10 is positioned at the bottom of a well bore such that the cutting elements 34 are adjacent the earth formation to be drilled. Equipment such as a rotary table or top drive may be used for rotating the drill string and the drill bit 10 within the well bore. Alternatively, the shank 20 of the drill bit 10 may be coupled directly to the drive shaft of a down-hole motor, which then may be used to rotate the drill bit 10. As the drill bit 10 is rotated, drilling fluid is pumped to the face 18 of the bit body 12 through the longitudinal bore 40 and the internal fluid passageways. Rotation of the drill bit 10 causes the cutting elements 34 to scrape across and shear away the surface of the underlying formation. The formation cuttings mix with and are suspended within the drilling fluid and pass through the junk slots 32 and the annular space between the well bore and the drill string to the surface of the earth formation.

Conventionally, bit bodies that include a particle-matrix composite material 15, such as the previously described bit body 12, have been fabricated in graphite molds using a so-called "infiltration" process. The cavities of the graphite molds are conventionally machined with a multi-axis machine tool. Fine features are then added to the cavity of the graphite mold by hand-held tools. Additional clay, which may comprise inorganic particles in an organic binder material, may be applied to surfaces of the mold within the mold cavity and shaped to obtain a desired final configuration of the mold. Where necessary, preform elements or displacements (which may comprise ceramic material, graphite, or resin-coated and compacted sand) may be positioned within the mold and used to define the internal passages, cutting element pockets 36, junk slots 32, and other features of the bit body 12.

After the mold cavity has been defined and displacements positioned within the mold as necessary, a bit body may be formed within the mold cavity. The cavity of the graphite mold is filled with hard particulate carbide material (such as tungsten carbide, titanium carbide, tantalum carbide, etc.). The preformed steel blank 16 then may be positioned in the mold at an appropriate location and orientation. The steel blank 16 may be at least partially submerged in the particulate carbide material within the mold.

The mold then may be vibrated or the particles otherwise packed to decrease the amount of space between adjacent particles of the particulate carbide material. A matrix material (often referred to as a "binder" material), such as a copper-based alloy, may be melted, and caused or allowed to infiltrate the particulate carbide material within the mold cavity. The mold and bit body 12 are allowed to cool to solidify the matrix material. The steel blank 16 is bonded to the particle-matrix composite material 15 that forms the crown 14 upon cooling of the bit body 12 and solidification of the matrix material. Once the bit body 12 has cooled, the bit body 12 is removed from the mold and any displacements are removed from the bit body 12. Destruction of the graphite mold typically is required to remove the bit body 12. Furthermore, the displacements used to define the internal fluid passageways, nozzle cavities, cutting element pockets 36, junk slots 32, and other features of the bit body 12 may be retained within the bit body 12 after removing the bit body 12 from the mold. Removal of the displacements from the bit body 12 without causing damage to the bit body 12 may be complicated and difficult. Hand-held tools such as chisels and power tools (e.g., drills and other hand-held rotary tools), as well as sand or grit blasters, may be used to remove the displacements from the bit body 12.

After the bit body 12 has been removed from the mold, the PDC cutting elements 34 may be bonded to the face 18 of the bit body 12 by, for example, brazing, mechanical affixation, or adhesive affixation. The bit body 12 also may be secured to the steel shank 20. As the particle-matrix composite material 15 used to form the crown 14 is relatively hard and not easily machined, the steel blank 16 may be used to secure the bit body 12 to the shank 20. Threads may be machined on an exposed surface of the steel blank 16 to provide the threaded connection 22 between the bit body 12 and the steel shank 20. The steel shank 20 may be threaded onto the bit body 12, and the weld 24 then may be provided along the interface between the bit body 12 and the steel shank 20.

BRIEF SUMMARY OF THE INVENTION

In some embodiments, the present invention includes displacement members that may be used to form at least a portion of a bit body of an earth-boring rotary drill bit. For example, a displacement member may include a hollow body having an exterior surface, at least a portion of which may be configured to define at least one surface of a bit body as the bit body is formed at least partially around the displacement member. In additional embodiments, the displacement member may include a porous body. For example, the displacement member may be comprised of a material including greater than about ten percent (10%) porosity by volume. In some embodiments, the displacement member may be comprised of a material including between about twenty percent (20%) and about seventy percent (70%) porosity by volume. Furthermore, in some embodiments, at least an exterior surface of the body of the displacement member may be substantially free of carbon.

In additional embodiments, the present invention includes methods of forming bit bodies of earth boring-rotary drill bits using such displacement members. For example, a displacement member may be positioned at a selected location within a cavity of a mold. The cavity may be filled with hard particles, and the hard particles may be infiltrated with a molten matrix material. As another example, a plurality of particles may be pressed to form a body, and at least one recess may be formed in the body. A displacement member may be positioned in the recess, and the body may be sintered to form a bit body.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

Figure 1:
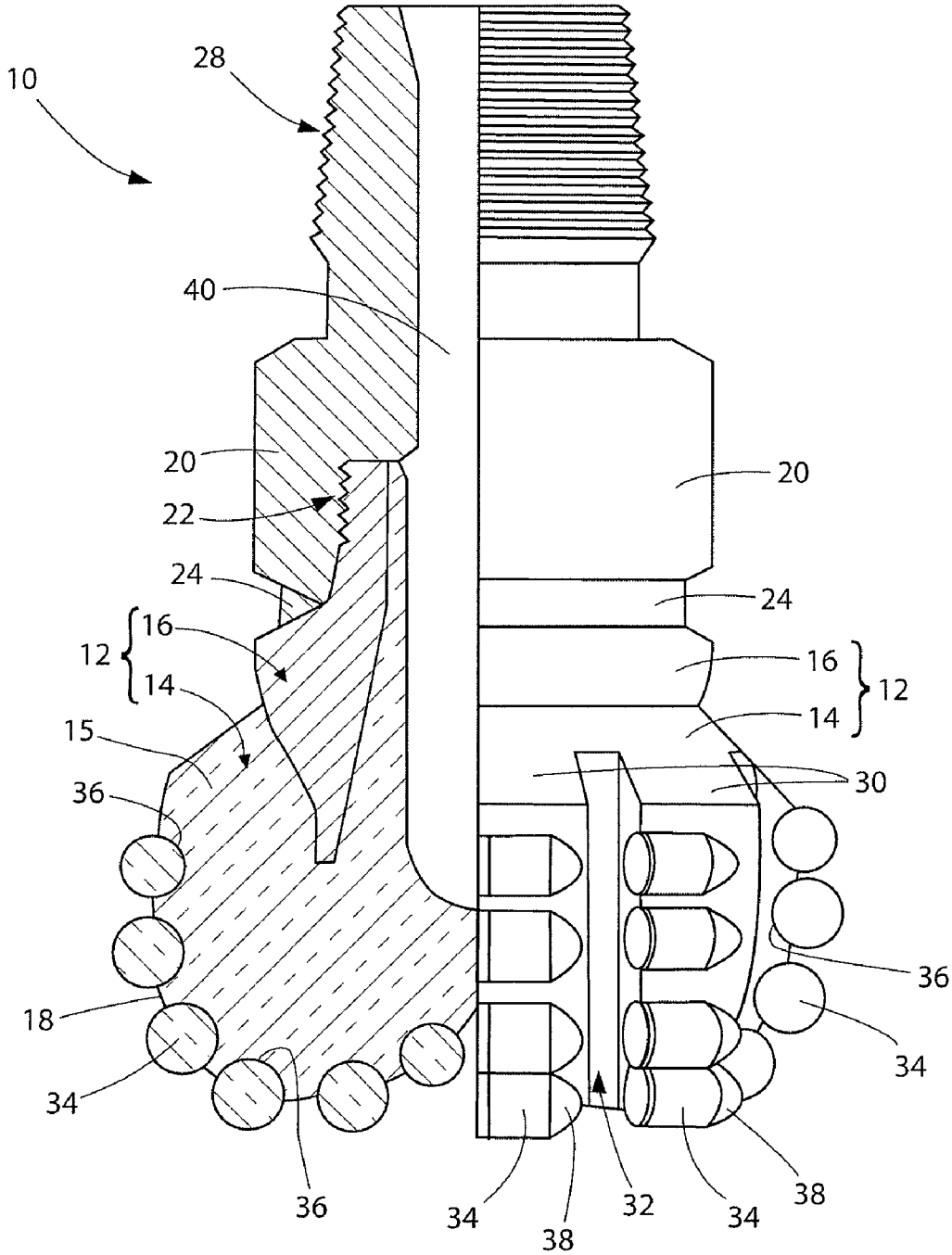
FIG. 1 (PRIOR ART)
FIG. 1 is a partial cross-sectional side view of a conventional earth-boring rotary drill bit having a bit body that includes a particle-matrix composite material 15.

The illustrations presented herein are not meant to be actual views of any particular material, apparatus, system, or method, but are merely idealized representations which are employed to describe the present invention. Additionally, elements common between figures may retain the same numerical designation.

The term "green" as used herein means unsintered.

The term "green bit body" as used herein means an unsintered structure comprising a plurality of discrete particles held together by a binder material, the structure having a size and shape allowing the formation of a bit body suitable for use in an earth-boring drill bit from the structure by subsequent manufacturing processes including, but not limited to, machining and densification.

The term "brown" as used herein means partially sintered.

The term "brown bit body" as used herein means a partially sintered structure comprising a plurality of particles, at least some of which have partially grown together to provide at least partial bonding between adjacent particles, the structure having a size and shape allowing the formation of a bit body suitable for use in an earth-boring drill bit from the structure by subsequent manufacturing processes including, but not limited to, machining and further densification. Brown bit bodies may be formed by, for example, partially sintering a green bit body.

The term "sintering" as used herein means densification of a particulate component involving removal of at least a portion of the pores between the starting particles (accompanied by shrinkage) combined with coalescence and bonding between adjacent particles.

As used herein, the term "[metal]-based alloy" (where [metal] is any metal) means commercially pure [metal] in addition to metal alloys wherein the weight percentage of [metal] in the alloy is greater than the weight percentage of any other component of the alloy.

As used herein, the term "material composition" means the chemical composition and microstructure of a material. In other words, materials having the same chemical composition but a different microstructure are considered to have different material compositions.

As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide.

The depth of well bores being drilled continues to increase as the number of shallow depth hydrocarbon-bearing earth formations continues to decrease. These increasing well bore depths are pressing conventional drill bits to their limits in terms of performance and durability. Several drill bits are often required to drill a single well bore, and changing a drill bit on a drill string can be expensive.

New particle-matrix composite materials 15 are currently being investigated in an effort to improve the performance and durability of earth-boring rotary drill bits. Furthermore, bit bodies comprising at least some of these new particle-matrix composite materials 15 may be formed from methods other than the previously described infiltration processes. By way of example and not limitation, bit bodies that include such particle-matrix composite materials 15 may be formed using powder compaction and sintering techniques. Such techniques are disclosed in U.S. patent application Ser. No. 11/271,153, filed Nov. 10, 2005, now U.S. Pat. No. 7,802,495, issued Sep. 28, 2010, and U.S. patent application Ser. No. 11/272,439, also filed Nov. 10, 2005, now U.S. Pat. No. 7,776,256, issued Aug. 17, 2010, the disclosure of each of which is incorporated herein in its entirety by this reference.

Figure 2:
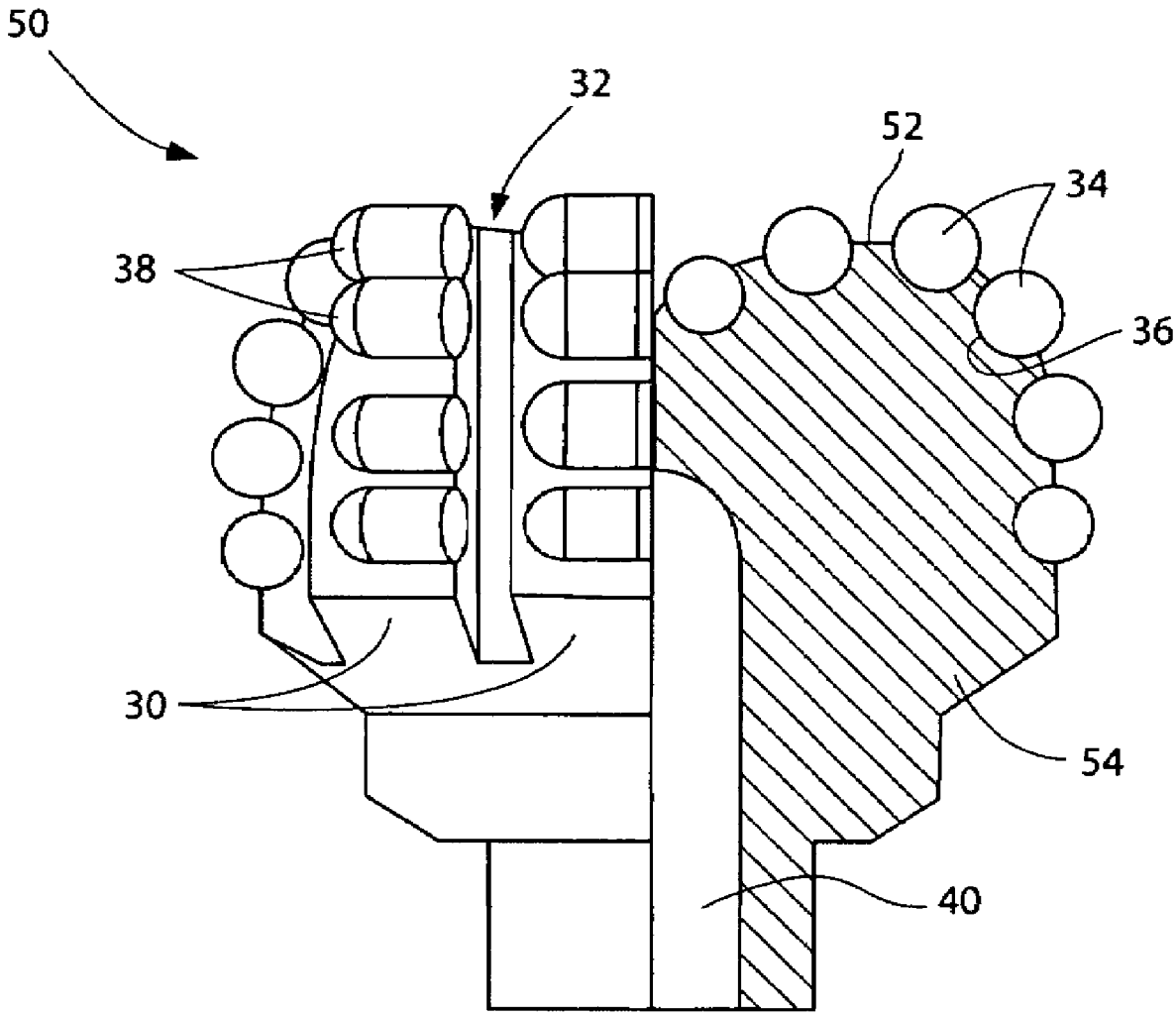
FIG. 2 is a partial cross-sectional side view of a bit body of a rotary drill bit that may be fabricated using methods that embody teachings of the present invention.

One example embodiment of a bit body 50 that may be formed using powder compaction and sintering techniques is illustrated in FIG. 2. As shown therein, the bit body 50 includes wings or blades 30 that are separated by junk slots 32, a longitudinal bore 40, and a plurality of PDC cutting elements 34 (or any other type of cutting element) secured within cutting element pockets 36 on the face 52 of the bit body 50. The PDC cutting elements 34 may be supported from behind by buttresses 38, which may be integrally formed with the bit body 50. In contrast to the bit body 12 shown in FIG. 1, the bit body 50 may not include a steel blank that is at least partially embedded in the bit body 50, such as the steel blank 16. In some embodiments, the bit body 50 may be predominantly comprised of a particle-matrix composite material 54. Although not shown in FIG. 2, the bit body 50 also may include internal fluid passageways that extend between the face 52 of the bit body 50 and the longitudinal bore 40. Nozzle inserts (not shown) also may be provided at face 52 of the bit body 50 within such internal fluid passageways.

As previously mentioned, the bit body 50 may be formed using powder compaction and sintering techniques. One non-limiting example of such a technique is briefly described below.

Figure 3A:
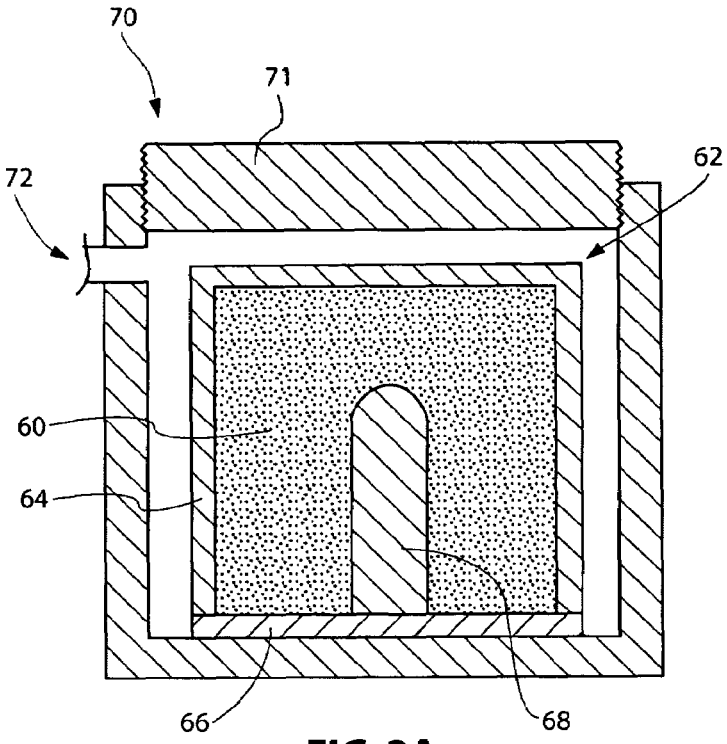
FIG. 3A is a cross-sectional view illustrating substantially isostatic pressure being applied to a powder mixture in a pressure vessel or container to form a green body from the powder mixture.

Referring to FIG. 3A, a powder mixture 60 may be pressed with substantially isostatic pressure within a mold or container 62. The powder mixture 60 may include a plurality of hard particles and a plurality of particles comprising a matrix material. Optionally, the powder mixture 60 may further include additives commonly used when pressing powder mixtures such as, for example, binders for providing structural strength to the pressed powder component, plasticizers for making the binder more pliable, and lubricants or compaction aids for reducing inter-particle friction and otherwise providing lubrication during pressing.

The container 62 may include a fluid-tight deformable member 64. For example, the fluid-tight deformable member 64 may be a substantially cylindrical bag comprising a deformable polymer material. The container 62 may further include a sealing plate 66, which may be substantially rigid. The deformable member 64 may be formed from, for example, an elastomer such as rubber, neoprene, silicone, or polyurethane. The deformable member 64 may be filled with the powder mixture 60 and vibrated to provide a uniform distribution of the powder mixture 60 within the deformable member 64. At least one insert or displacement member 68 may be provided within the deformable member 64 for defining features of the bit body 50 such as, for example, the longitudinal bore 40 (FIG. 2). Alternatively, the displacement member 68 may not be used and the longitudinal bore 40 may be subsequently formed using a conventional machining process. The sealing plate 66 then may be attached or bonded to the deformable member 64 providing a fluid-tight seal therebetween.

The container 62 (with the powder mixture 60 and any desired displacement members 68 contained therein) may be provided within a pressure chamber 70. A removable cover 71 may be used to provide access to the interior of the pressure chamber 70. A fluid (which may be substantially incompressible) such as, for example, water, oil, or gas (such as, for example, air or nitrogen) is pumped into the pressure chamber 70 through an opening 72 at high pressures using a pump (not shown). The high pressure of the fluid causes the walls of the deformable member 64 to deform. The fluid pressure may be transmitted substantially uniformly to the powder mixture 60.

Figure 3B:
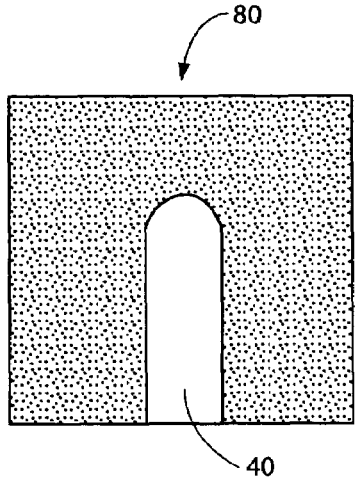
FIG. 3B is a cross-sectional view of the green body shown in FIG. 3A after removing the green body from the pressure vessel.

Substantially isostatic pressing of the powder mixture 60 may form a green powder component or green body 80 shown in FIG. 3B, which can be removed from the pressure chamber 70 and container 62 after pressing.

In an alternative method of pressing the powder mixture 60 to form the green body 80 shown in FIG. 3B, the powder mixture 60 may be uniaxially pressed in a mold or die (not shown) using a mechanically or hydraulically actuated plunger by methods that are known to those of ordinary skill in the art of powder processing.

The green body 80 shown in FIG. 3B may include a plurality of particles (hard particles and particles of matrix material) held together by interparticle friction forces and a binder material provided in the powder mixture 60 (FIG. 3A), as previously described. Certain structural features may be machined in the green body 80 using conventional machining techniques including, for example, turning techniques, milling techniques, and drilling techniques. Hand-held tools also may be used to manually form or shape features in or on the green body 80. By way of example and not limitation, blades 30, junk slots 32 (FIG. 2), and other features may be machined or otherwise formed in the green body 80 to form a partially shaped green body 84 shown in FIG. 3C.

Figure 3C:
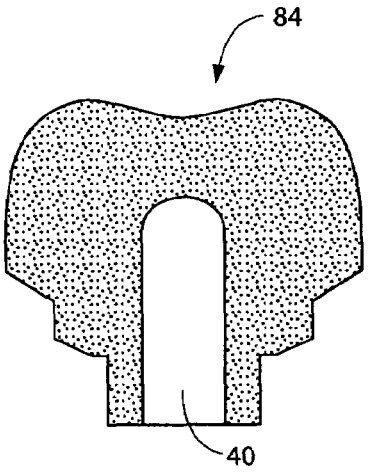
FIG. 3C is a cross-sectional view of another green body formed by machining the green body shown in FIG. 3B.
Figure 3D:
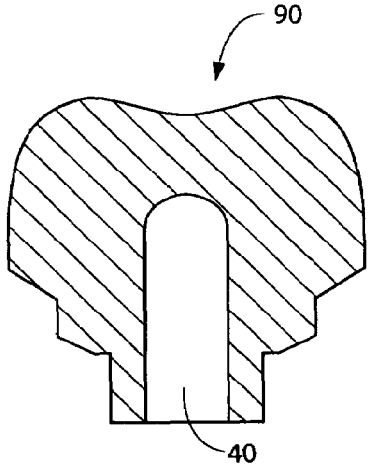
FIG. 3D is a cross-sectional view of a brown body that may be formed by partially sintering the green body shown in FIG. 3C.

The partially shaped green body 84 shown in FIG. 3C may be at least partially sintered to provide a brown body 90 shown in FIG. 3D, which has less than a desired final density. The brown body 90 may be substantially machinable due to the remaining porosity therein. Certain structural features may be machined in the brown body 90 using conventional machining techniques including, for example, turning techniques, milling techniques, and drilling techniques. Hand-held tools also may be used to manually form or shape features in or on the brown body 90.

Figure 3E:
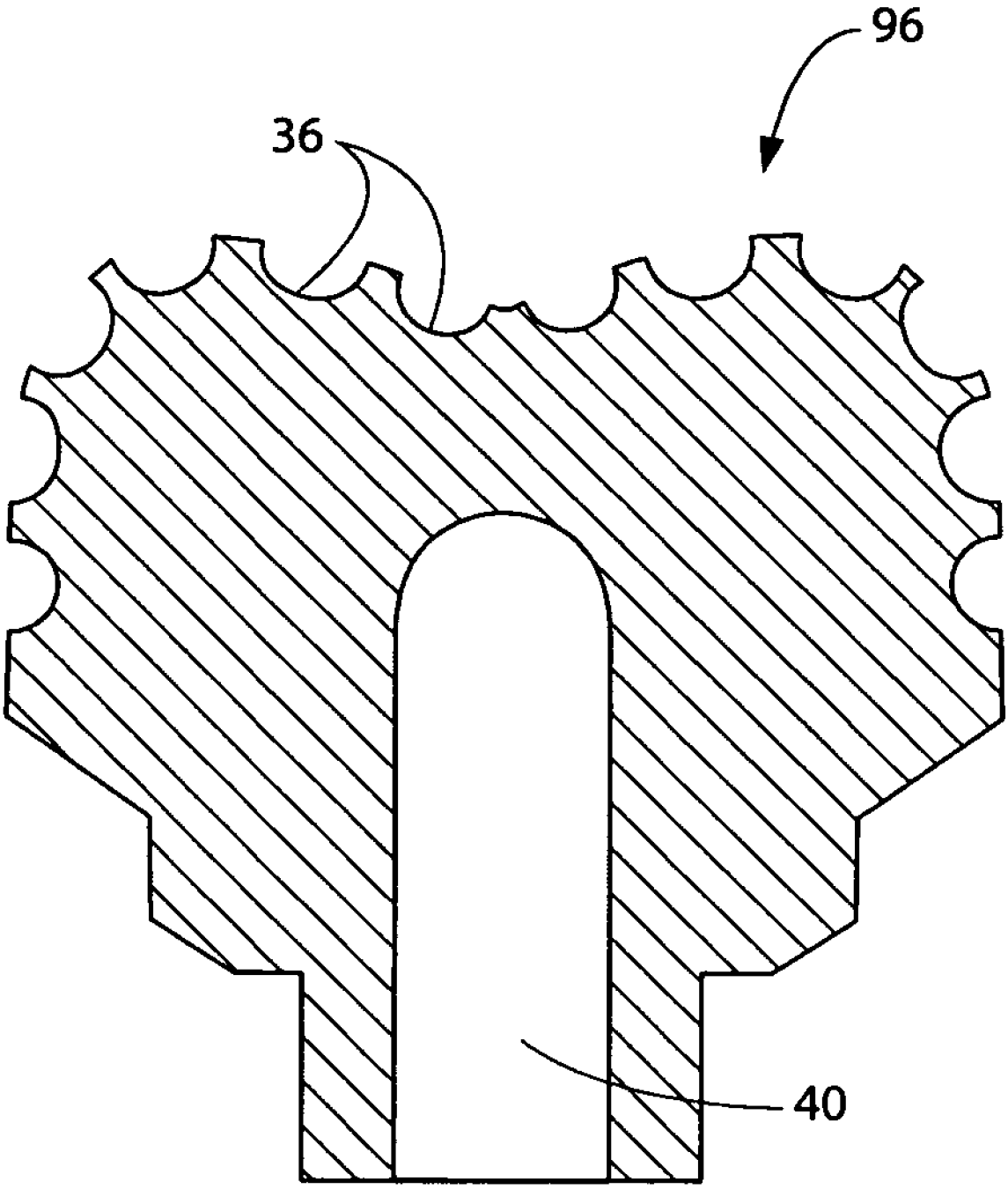
FIG. 3E is a cross-sectional view of another brown body that may be formed by partially machining the brown body shown in FIG. 3D.

By way of example and not limitation, internal fluid passageways (not shown), cutting element pockets 36, and buttresses 38 (FIG. 2) may be machined or otherwise formed in the brown body 90 to form a brown body 96 shown in FIG. 3E.

The brown body 96 shown in FIG. 3E then may be fully sintered to a desired final density to provide the previously described bit body 50 shown in FIG. 2.

In additional methods, the green body 80 shown in FIG. 3B may be partially sintered to form a brown body without prior machining, and all necessary machining may be performed on the brown body prior to fully sintering the brown body to a desired final density. Alternatively, all necessary machining may be performed on the green body 80 shown in FIG. 3B, which then may be fully sintered to a desired final density.

As sintering involves densification and removal of porosity within a structure, the structure being sintered will shrink during the sintering process. As a result, dimensional shrinkage must be considered and accounted for when machining features in green or brown bodies that are less than fully sintered.

As the brown body 96 shown in FIG. 3E shrinks during sintering, geometric tolerances (e.g., size and shape) of the various features of the brown body 96 may vary in a potentially undesirable manner. For example, it may be necessary or desired to provide substantially cylindrical cutting element pockets 36 in the bit body 50 (FIG. 2). The cutting element pockets 36 as machined in the brown body 96 shown in FIG. 3E may be substantially cylindrical and may have a larger size (e.g., diameter) than the desired size of the cutting element pockets 36 to be formed in the fully sintered bit body 50 to accommodate for shrinkage during the sintering process. After sintering the brown body 96 to a final density, however, the cutting element pockets 36 potentially may have a size and/or shape that prevents receipt of a cutting element 34 therein. For example, one or more cutting element pockets 36 may be too small or not sufficiently cylindrical or otherwise shaped after sintering the brown body 96 to a desired final density. As a result, additional machining of the bit body 50 (FIG. 2) in the fully sintered state may be required in some cases, which may be difficult due to the relatively wear-resistant and abrasive properties of the particle-matrix composite material 54 (FIG. 2) from which the bit body 50 is formed. Such problems may be encountered with features of the bit body 50 other than cutting element pockets 36 such as, for example, fluid courses, nozzle recesses, junk slots, etc.

During sintering and partial sintering processes, refractory structures or displacement members may be used to support at least portions of the green or brown bodies to attain or maintain desired geometrical aspects (such as, for example, size and shape) during the sintering processes.

Figure 4A:
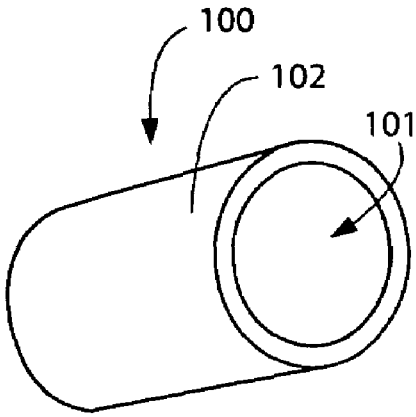
FIG. 4A is a perspective view of one example of a displacement member that may be provided within a cutting element pocket of a green or brown body, such as that shown in FIG. 3E, while the green or brown body is sintered to a final density to form a bit body of a rotary drill bit.
Figure 4B:
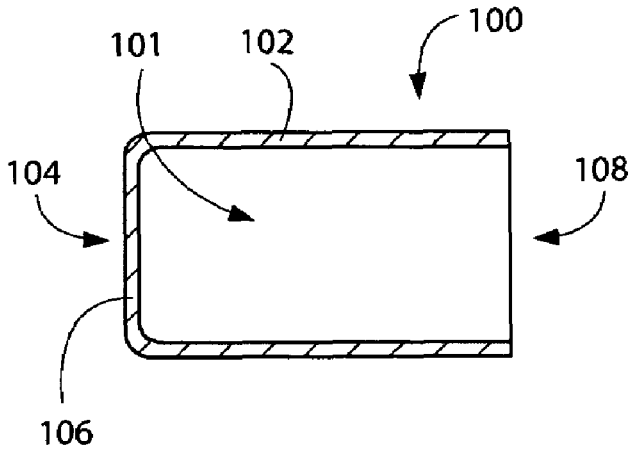
FIG. 4B is a cross-sectional view of the displacement member shown in FIG. 4A.

A displacement member 100 that provides one example of a displacement member that embodies teachings of the present invention is shown in FIGS. 4A and 4B. As shown therein, the displacement member 100 may be hollow and generally cylindrical. In other words, the displacement member 100 may include at least one internal cavity 101 defined by a surface of the displacement member 100. For example, the displacement member 100 may include a generally cylindrical outer wall 102. In some embodiments, the displacement member 100 may be substantially closed at a first end 104 by a generally planar end wall 106, and may be substantially open at a second end 108. In additional embodiments, the displacement member 100 may have any simple or complex geometrical shape.

The displacement member 100 may be predominantly comprised of a ceramic or other high-temperature refractory material such as, for example, oxides and nitrides of aluminum, cerium, magnesium, silicon, zinc, and zirconium. Some particular non-limiting examples include alumina ($Al_2O_3$), aluminum nitride (AlN), boron nitride (BN), ceria ($CeO_2$), magnesia (MgO), silica ($SiO_2$), silicon nitride ($Si_3N_4$), zinc oxide (ZnO), and zirconia ($ZrO_2$). Any ceramic or other high-temperature refractory material may be used that will remain solid and will not undergo deformation at a suitable sintering temperature and that will not react with the material of the bit body 50 in a detrimental manner. Furthermore, the ceramic or other high-temperature refractory material may be selected to exhibit a low average linear coefficient of thermal expansion over the range of temperatures extending from approximately room temperature to the sintering temperature. For example, the ceramic or other high-temperature refractory material may be selected to exhibit an average linear coefficient of thermal expansion of less than about $10.0\times10^{-6}$ per degree Celsius over the range of temperatures extending from approximately room temperature to the sintering temperature.

In some embodiments, at least an exterior surface of the displacement member 100 may be substantially free of carbon, as carbon may detrimentally react with the material of the bit body 50. In some embodiments, the entire displacement member 100 may be substantially free of carbon. For example, the entire displacement member 100 may comprise less than about one atomic percent (1.0%) carbon.

By using a displacement member that is hollow or includes at least one internal cavity, such as the displacement member 100, removal of the displacement member from a fully sintered bit body 50 may be facilitated. For example, it may be relatively easier to break, fracture, or otherwise destroy a displacement member that is hollow or includes at least one internal cavity than it would be to break or fracture a displacement member that is substantially solid.

In some embodiments, the generally cylindrical outer wall 102 and the generally planar end wall 106 each may be substantially fully dense (i.e., contain minimal amounts of porosity). In additional embodiments, however, the displacement member 100 (i.e., the generally cylindrical outer wall 102 and the generally planar end wall 106) may include a significant amount of porosity, as described in further detail below.

Figure 5A:
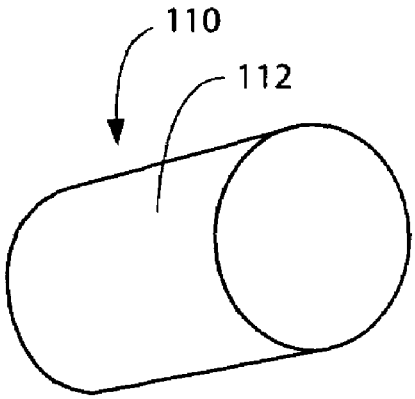
FIG. 5A is a perspective view of another example of a displacement member that may be provided within a cutting element pocket of a green or brown body, such as that shown in FIG. 3E, while the green or brown body is sintered to a final density to form a bit body of a rotary drill bit.
Figure 5B:
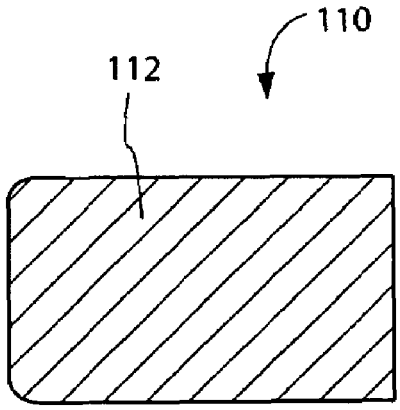
FIG. 5B is a cross-sectional view of the displacement member shown in FIG. 5A.

Another displacement member 110 providing an additional example of a displacement member that embodies teachings of the present invention is shown in FIGS. 5A and 5B. As shown therein, the displacement member 110 may include a substantially cylindrical body 112. In additional embodiments, the displacement member 110 may have any other simple or complex geometric shape.

The displacement member 110 may be formed from or include any of the ceramic or other high-temperature refractory materials described above in relation to the displacement member 100.

As shown in FIGS. 5A and 5B, in some embodiments, the displacement member 110 may not be hollow and may not include any internal cavity. The displacement member 110, however, may include a significant amount of porosity. By way of example and not limitation, the displacement member 110 may include greater than about ten percent (10%) porosity by volume. In some embodiments, the displacement member 110 may include between about twenty percent (20%) and about seventy percent (70%) porosity by volume. More particularly, the displacement member 110 may include between about thirty percent (30%) and about fifty percent (50%) porosity by volume.

Such a porous displacement member 110 may be formed by, for example, providing a porous sponge having an open pore structure and a shape similar to that of the desired displacement member 110. The size of the porous sponge may be larger than that of the desired displacement member 110 to account for subsequent shrinkage during sintering of the porous displacement member 110. By way of example and not limitation, the porous sponge may comprise a polymer material. A ceramic casting slip may be provided by suspending relatively fine ceramic particles comprising the material to be used to form the displacement member 110 in a liquid. The ceramic casting slip may be allowed to infiltrate the open pore structure of the porous sponge. The liquid material of the ceramic casting slip then may be allowed to evaporate or drain from the porous sponge, leaving the relatively fine ceramic particles behind in the porous sponge. The dried sponge structure then may be heated in a furnace to a temperature sufficient to cause at least partial sintering of the ceramic particles in the open pore structure of the porous sponge, and to cause the porous sponge to burn off or combust, leaving behind only a porous displacement member 110.

In another method, a polymer precursor material may be added to a ceramic casting slip. The ceramic casting slip may be provided in a mold or die, and the polymer precursor material may be caused to polymerize. Polymerization of the polymer precursor material may form a gel structure. The ceramic particles from the ceramic casting slip may be trapped or retained within the polymer network of the gel structure. The gel structure then may be heated in a furnace to a temperature sufficient to cause at least partial sintering of the ceramic particles in the gel structure, and to cause the polymer material to burn off or combust, leaving behind only a porous displacement member 110.

Any other methods for forming structures comprising porous ceramic or other high-temperature refractory materials also may be used to form the displacement member 110.

By using a displacement member comprising a material that includes a substantial or significant amount of porosity, such as the displacement member 110, removal of the displacement member from a fully sintered bit body 50 may be facilitated. For example, it may be relatively easier to break, fracture, or otherwise destroy a displacement member that includes a substantial or significant amount of porosity than it would be to similarly destroy a displacement member that is substantially solid and does not include pores.

In additional embodiments, the displacement member 110 may be hollow and may include one or more internal cavities, as previously described in relation to the displacement member 100 shown in FIGS. 4A and 4B.

Figure 6A:
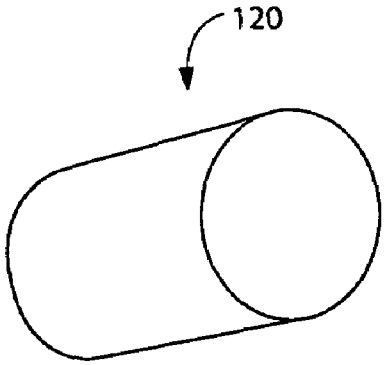
FIG. 6A is a perspective view of yet another example of a displacement member that may be provided within a cutting element pocket of a green or brown body, such as that shown in FIG. 3E, while the green or brown body is sintered to a final density to form a bit body of a rotary drill bit.
Figure 6B:
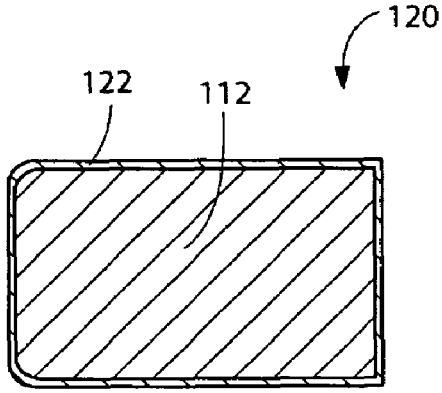
FIG. 6B is a cross-sectional view of the displacement member shown in FIG. 6A.

Another displacement member 120 providing yet another example of a displacement member that embodies teachings of the present invention is shown in FIGS. 6A and 6B. As shown therein, the displacement member 120 may include a substantially cylindrical body 112, as previously described in relation to FIGS. 5A and 5B. The displacement member 120, however, further includes an outer region 122 that includes a reduced amount of porosity relative to the interior region of the body 112. By way of example and not limitation, the outer region 122 may include less than about ten percent (10%) porosity by volume. In additional embodiments, at least a portion of the outer region 122 of the displacement member 120 may be substantially nonporous. In this configuration, at least a portion of an exterior surface of the displacement member 120 may be substantially nonporous.

By way of example and not limitation, the outer region 122 may comprise a coating disposed over at least a portion of an exterior surface of the body 112 of the displacement member 120. In additional embodiments, the outer region 122 may comprise an integral portion of the body 112 that includes a reduced amount of porosity relative to the remaining portion of the body 112. Furthermore, in some embodiments, the outer region 122 may exhibit a porosity gradient that extends from relatively little porosity proximate an outer surface of the displacement member 120 to relatively higher porosity proximate the interior regions of the body 112 of the displacement member 112. In such embodiments, there may be no readily identifiable boundary between the outer region 122 and in the inner regions of the body 112.

The outer region 122 may be substantially free of carbon. By way of example and not limitation, the outer region 122 may include a ceramic or other high temperature refractory material such as, for example, oxides and nitrides of aluminum, cerium, magnesium, silicon, zinc, and zirconium. Some particular non-limiting examples include alumina ($Al_2O_3$), aluminum nitride (AlN), boron nitride (BN), ceria ($CeO_2$), magnesia (MgO), silica ($SiO_2$), silicon nitride ($Si_3N_4$), zinc oxide (ZnO), and zirconia ($ZrO_2$). In some embodiments, the material used to form the outer region 122 may be substantially similar or identical to the material used to form the body 112 (only including less or no porosity). The outer region 122 may be deposited using, for example, a chemical vapor deposition (CVD) process. As another example, the outer region 122 may be formed by immersing the porous body 112 in a ceramic slurry to coat the exterior surfaces of the porous body 112. As yet another example, the outer region 122 may be formed by painting or spraying a slurry onto the exterior surfaces of the porous body 112. As yet another example, the outer region 122 may be formed during extrusion of a porous ceramic precursor material through a constricting die to cause the surface of the die to smooth, smear, or otherwise remove porosity from the exterior surfaces of the porous ceramic precursor material. At least a segment of the extruded ceramic precursor material may be subsequently sintered to form the displacement member 120.

The outer region 122 may have a thickness in a range extending from a few microns to several millimeters or more.

Figure 7A:
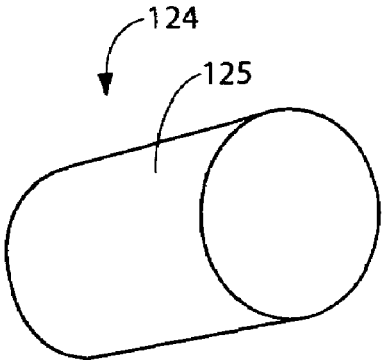
FIG. 7A is a perspective view of yet another example of a displacement member that may be provided within a cutting element pocket of a green or brown body, such as that shown in FIG. 3E, while the green or brown body is sintered to a final density to form a bit body of a rotary drill bit.
Figure 7B:
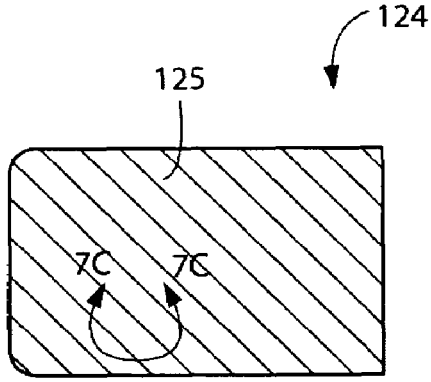
FIG. 7B is a cross-sectional view of the displacement member shown in FIG. 7A.
Figure 7C:
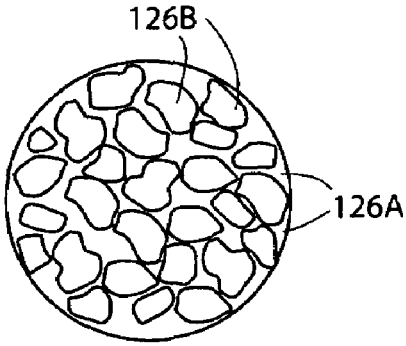
FIG. 7C is an enlarged view illustrating an example of a microstructure that may be exhibited by a body of the displacement member shown in FIGS. 7A and 7B.

Another displacement member 124 providing yet another example of a displacement member that embodies teachings of the present invention is shown in FIGS. 7A-7C. As shown therein, the displacement member 124 may include a substantially cylindrical body 125. The substantially cylindrical body 125 may be substantially fully dense. In other words, the substantially cylindrical body 125 may include little or no porosity. FIG. 7C is an enlarged view of an example of how the microstructure of the substantially cylindrical body 125 may appear under magnification. As shown in FIG. 7C, the substantially cylindrical body 125 may include more than one phase. At least one of the phases may be selected to decrease the strength and/or the fracture toughness of the substantially cylindrical body 125. By way of example and not limitation, the substantially cylindrical body 125 may include a first continuous ceramic phase 126A having a first melting point and a second discrete or discontinuous ceramic phase 126B having a second melting point that is higher than the first melting point of the first ceramic phase 126A.

The substantially cylindrical body 125 of the displacement member 124 may be formed using conventional ceramic processing techniques. Such conventional ceramic processing techniques include, for example, conventional powder processing and shape-forming techniques that may be used to form a green body including particles comprising the first ceramic phase 126A and particles comprising the second ceramic phase 126B. Such a green body then may be sintered (using a solid-state sintering process or a liquid-phase sintering process) at temperatures at least below the second, higher melting point of the second ceramic phase 126B to form the substantially cylindrical body 125 of the displacement member 124.

The interfaces between the first ceramic phase 126A and the second ceramic phase 126B may cause the generally cylindrical body 125 to exhibit relatively less strength and/or toughness relative to a fully dense generally cylindrical body 125 comprising the first ceramic phase 126A alone.

By way of example and not limitation, the first ceramic phase 126A may comprise between about ten percent (10%) and about ninety percent (90%) by volume of the generally cylindrical body 125. More particularly, the first ceramic phase 126A may comprise between about twenty-five percent (25%) and about seventy-five percent (75%) by volume of the generally cylindrical body 125. Even more particularly, the first ceramic phase 126A may comprise between about forty percent (40%) and about sixty percent (60%) by volume of the generally cylindrical body 125.

As one particular nonlimiting example, the first ceramic phase 126A may comprise alumina ($Al_2O_3$) and the second ceramic phase 126B may comprise magnesia (MgO). In this example, a green body comprising particles of alumina ($Al_2O_3$) and particles of magnesia (MgO) may be at least partially sintered at temperatures proximate the melting point of alumina ($Al_2O_3$), but below the melting point of magnesia (MgO).

Figure 8A:
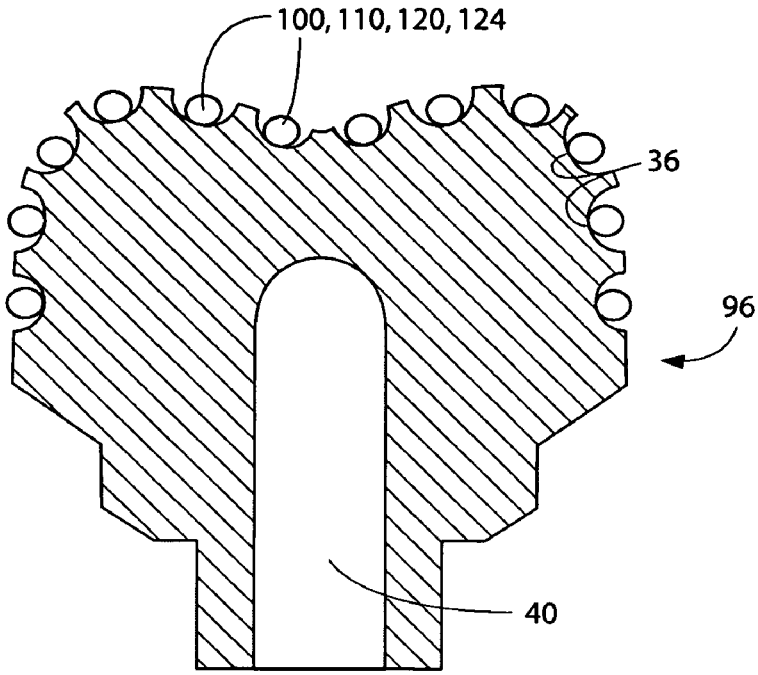
FIG. 8A is a cross-sectional view of the brown body shown in FIG. 3E illustrating displacement members that embody teachings of the present invention positioned in cutting element pockets thereof.

Referring to FIG. 8A, displacement members that embody teachings of the present invention, such as, for example, the displacement members 100, 110, 120, 124 may be provided in one or more recesses or other features formed in the shaped brown body 96, previously described with reference to FIG. 3E. For example, a displacement member 100, 110, 120, 124 may be provided in each of the cutting element pockets 36. In some methods, the displacement members 100, 110, 120, 124 may be secured at a selected location in the cutting element pockets 36 using, for example, an adhesive material. Although not shown, additional displacement members that embody teachings of the present invention may be provided in additional recesses or features of the shaped brown body 96, such as, for example, within fluid passageways, nozzle recesses, etc.

Figure 8B:
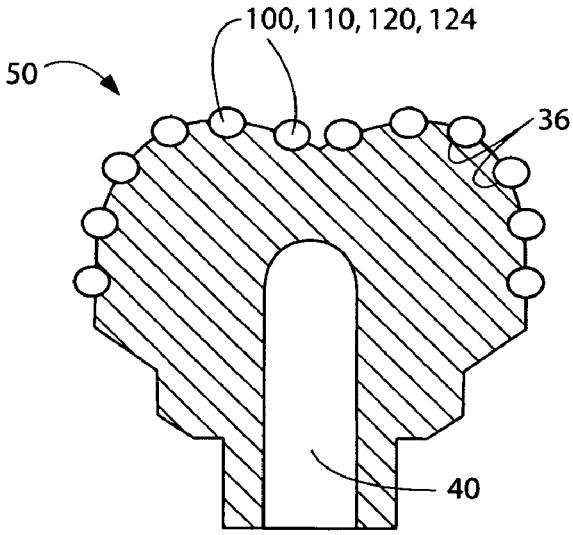
FIG. 8B is a cross-sectional side view of a bit body that may be formed by sintering the brown body shown in FIG. 8A to a desired final density and illustrates displacement members in the cutting element pockets thereof.
Figure 8C:
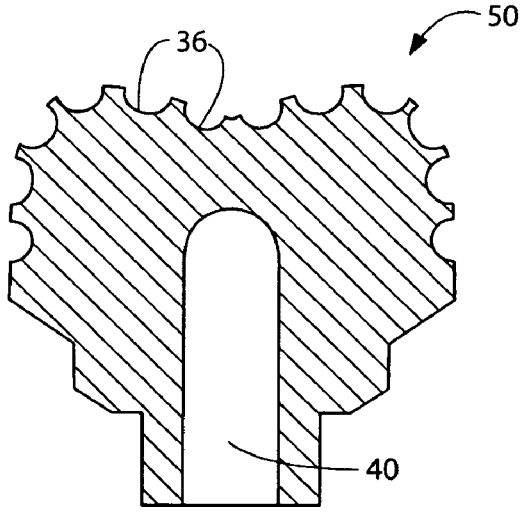
FIG. 8C is a cross-sectional side view of the bit body shown in FIG. 8B after removing the displacement members from the cutting element pockets.

After providing the displacement members 100, 110, 120, 124 in the recesses or other features of the shaped brown body 96, the shaped brown body 96 may be sintered to a final density to provide the fully sintered bit body 50 (FIG. 2), as shown in FIG. 8B. After sintering the shaped brown body 96 to a final density, however, the displacement members 100, 110, 120, 124 may remain secured within the various recesses or other features of the fully sintered bit body 50 (e.g., within the cutting element pockets 36). The displacement members 100, 110, 120, 124 may be removed from the cutting element pockets 36 of the bit body 50, as shown in FIG. 8C.

As previously discussed, the displacement members 100, 110, 120, 124 may be broken or fractured into relatively smaller pieces to facilitate removal of the displacement members 100, 110, 120, 124 from the fully sintered bit body 50. By using displacement members that embody teachings of the present invention (such as, for example, the displacement members 100, 110, 120, 124), the displacement members may be more readily broken or fractured, which may facilitate removal of the displacement members from the fully sintered bit body.

In additional methods, the displacement members 100, 110, 120, 124 may be provided in recesses or other features of a substantially fully shaped green body (not shown), and the substantially fully shaped green body then may be sintered to a final density to form the bit body 50.

Figure 9:
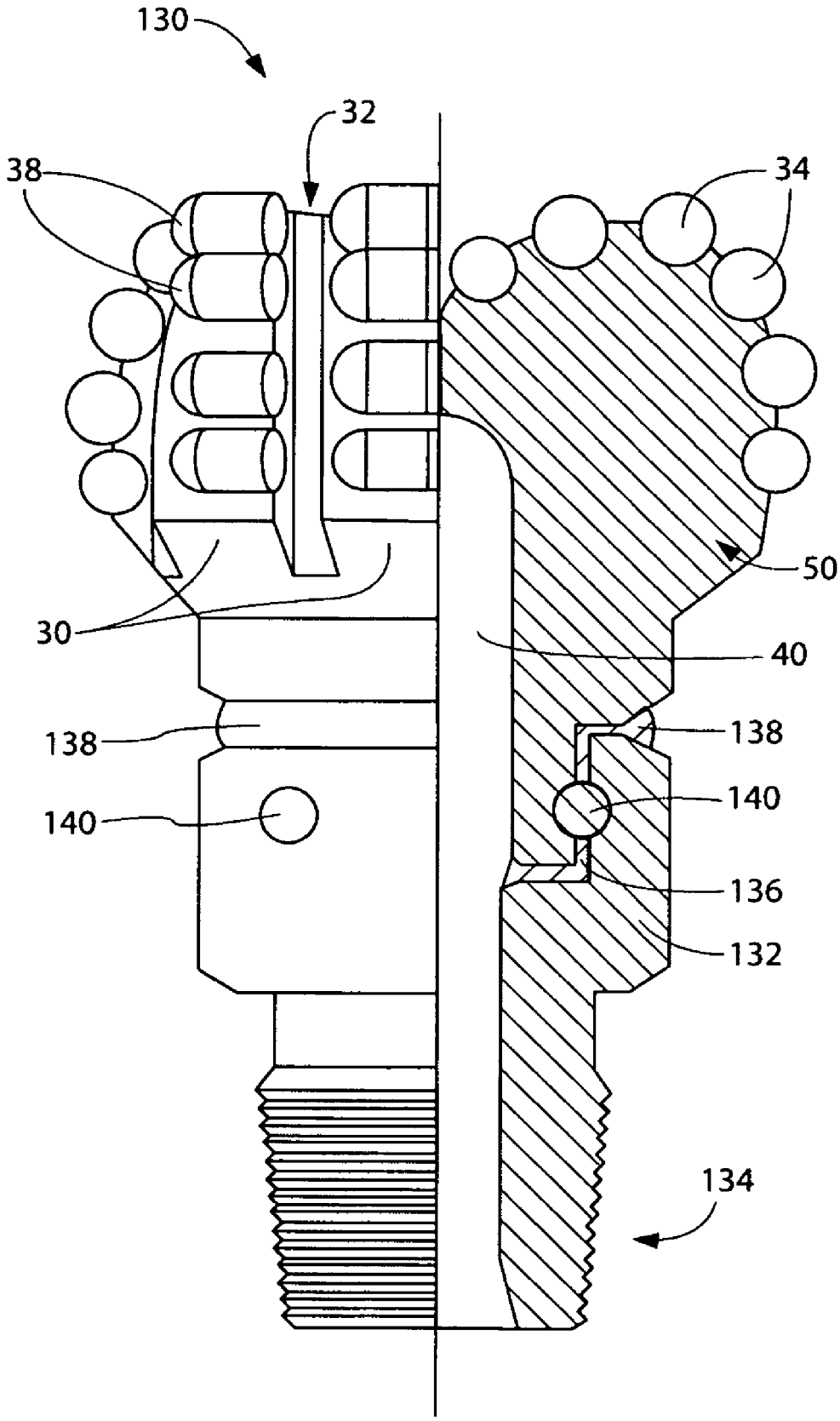
FIG. 9 is a partial cross-sectional side view of an earth-boring rotary drill bit that may be formed by securing cutting elements within the cutting element pockets of the bit body shown in FIG. 8C and securing the bit body to a shank for attachment to a drill string.

Referring to FIG. 9, after forming the bit body 50, cutting elements 34 may be secured within the cutting element pockets 36 to form an earth-boring rotary drill bit 130. The bit body 50 also may be secured to a shank 132 that has a threaded portion 134 for connecting rotary drill bit 130 to a drill string (not shown). The bit body 50 also may be secured to a shank 132 by, for example, providing a brazing material 136 between the bit body 50 and the shank 132. In addition, a weld 138 may be provided around the rotary drill bit 130 along an interface between the bit body 50 and the shank 132. Furthermore, one or more pins 140 or other mechanical fastening members may be used to secure the bit body 50 and the shank 132 together. Such methods for securing the bit body 50 and the shank 132 together are discussed in further detail in U.S. patent application Ser. No. 11/271,153, filed Nov. 10, 2005, the disclosure of which is incorporated herein in its entirety by this reference.

Figure 10:
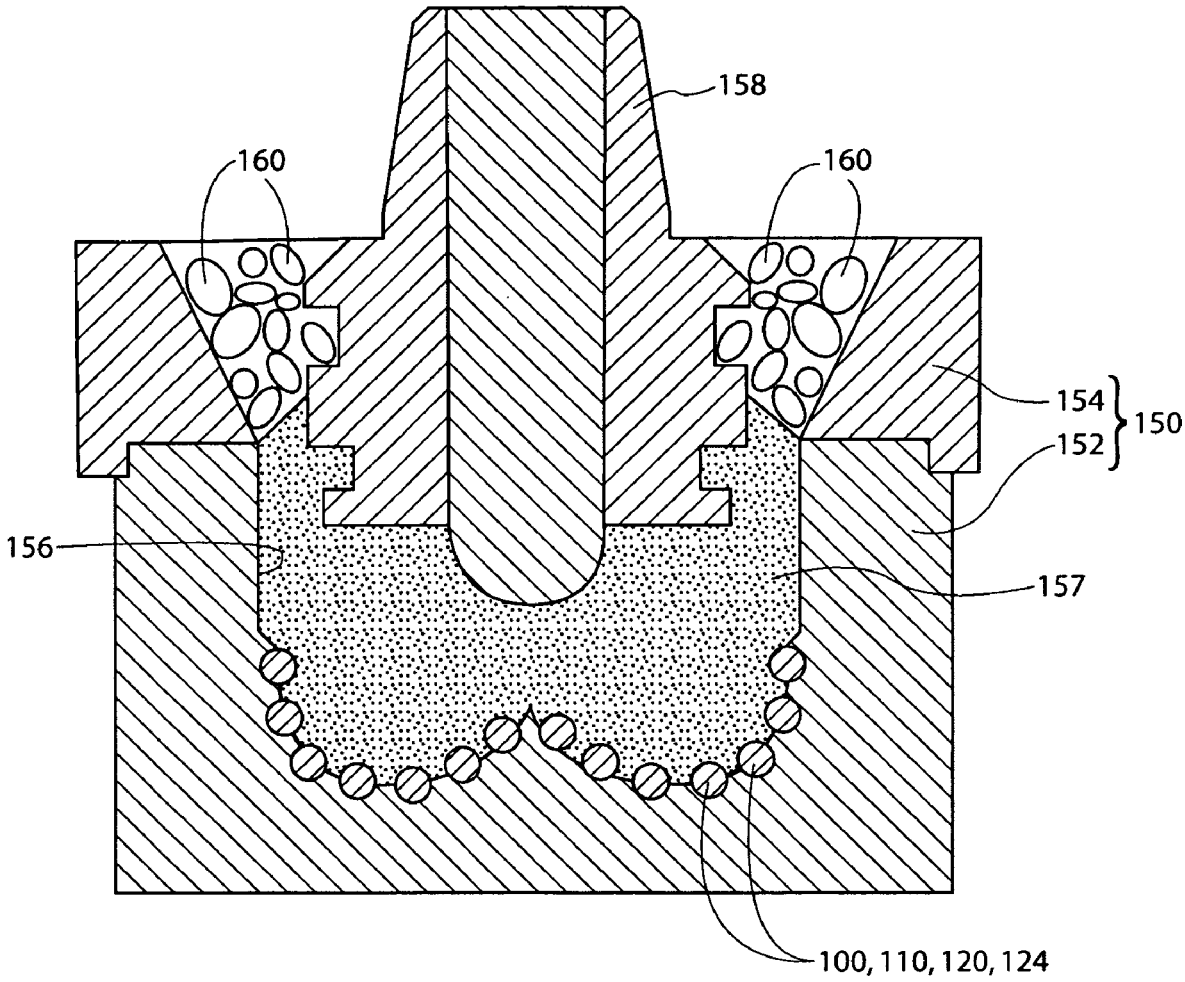
FIG. 10 is a cross-sectional view illustrating another method of forming a bit body of an earth-boring rotary drill bit using displacement members that embody teachings of the present invention positioned within a mold cavity.

Referring to FIG. 10, displacement members that embody teachings of the present invention (such as, for example, the displacement members 100, 110, 120, 124) also may be used in conventional infiltration methods for forming earth-boring rotary drill bits. For example, a mold 150 may be provided, which may include a lower portion 152 and an upper portion 154. A plurality of displacement members that embody teachings of the present invention, such as, for example, the displacement members 100, 110, 120, 124, may be provided at selected locations in a cavity 156 within the mold 150. For example, displacement members 100, 110, 120, 124 may be provided at locations corresponding to cutting element pockets 36 (FIG. 2), fluid passageways, nozzle recesses, etc.

A cavity 156 within the mold 150 may be filled with particles 157 comprising a hard material (such as, for example, tungsten carbide, titanium carbide, tantalum carbide, etc.). A preformed blank 158 comprising a metal or metal alloy such as steel then may be positioned in the mold 150 at an appropriate location and orientation. The blank 158 may be at least partially submerged in the particles 157 comprising hard material within the mold 150.

The mold 150 may be vibrated or the particles 157 otherwise packed to decrease the amount of space between adjacent particles 157. A matrix material (often referred to as a "binder" material) may be melted, and caused or allowed to infiltrate the particles 157 comprising a hard material within the cavity 156 of the mold 150. By way of example, the matrix material may comprise copper or a copper-based alloy.

As a nonlimiting example, particles 160 comprising a matrix material may be provided over the particles 157 comprising a hard material, as shown in FIG. 9. The mold 150, as well as the particles 157 of hard material and the particles 160 of matrix material, may be heated to a temperature above the melting point of the matrix material to cause the particles 160 of matrix material to melt. The molten matrix material may be caused or allowed to infiltrate the particles 157 comprising a hard material within the cavity 156 of the mold 150.

The mold 150 then may be allowed or caused to cool to solidify the matrix material. The steel blank 158 may be bonded to the particle-matrix composite material 15 that forms the resulting bit body (not shown) upon solidification of the matrix material. Once the bit body has cooled, the bit body may be removed from the mold, and any displacement members 100, 110, 120, 124 may be removed from the bit body. By using displacement members that embody teachings of the present invention (such as the displacement members 100, 110, 120, 124) in an infiltration process used to form a bit body of an earth-boring rotary drill bit, removal of the displacement members 100, 110, 120, 124 from the bit body may be facilitated.

As previously discussed herein, displacement members that embody teachings of the present invention may be more readily removed from a bit body after forming the bit body at least partially around the displacement members. Furthermore, displacement members that embody teachings of the present invention may be relatively more chemically inert with respect to materials used to form bit bodies relative to displacement members known in the art. In addition, by using displacement members that are relatively chemically inert with respect to materials used to form bit bodies, displacement members that embody teachings of the present invention may more accurately or precisely define the desired geometry of various features of a bit body formed around the displacement members.

While teachings of the present invention are described herein in relation to displacement members for use in forming earth-boring rotary drill bits that include fixed cutters, displacement members that embody teachings of the present invention may be used to form other subterranean tools including, for example, core bits, eccentric bits, bicenter bits, reamers, mills, drag bits, roller cone bits, and other such structures known in the art may be formed by methods that embody teachings of the present invention. Furthermore, displacement members that embody teachings of the present invention may be used to form any article of manufacture in which it is necessary or desired to use a displacement member to define a surface of the article of manufacture as the article of manufacture is formed at least partially around the displacement member.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors.

What is claimed is:

1. An intermediate structure, comprising:

a brown body comprising a plurality of hard particles infiltrated with a matrix material; and a displacement member comprising a hollow body adjacent to and in contact with the brown body, the hollow body having an exterior surface and a generally cylindrical internal surface defining an internal cavity within the hollow body, at least a portion of the exterior surface of the hollow body in contact with the brown body and having a shape configured to define at least one surface of a bit body of an earth-boring rotary drill bit as the bit body is formed at least partially around the exterior surface of the hollow body, wherein the hollow body of the displacement member does not comprise a portion or a component of the earth-boring rotary drill bit.

2. The intermediate structure of claim 1, wherein the hollow body has a first closed end and a second, opposing open end.

3. The intermediate structure of claim 1, wherein the hollow body comprises a ceramic material.

4. The intermediate structure of claim 1, wherein the hollow body comprises a material having between about twenty percent (20%) and about seventy percent (70%) porosity by volume.

* * * * *

UNITED STATES PATENT AND TRADEMARK OFFICE

CERTIFICATE OF CORRECTION

PATENT NO. : 8,272,295 B2
APPLICATION NO. : 11/635432
DATED : September 25, 2012
INVENTOR(S) : Redd H. Smith and John H. Stevens It is certified that error appears in the above-identified patent and that said Letters Patent is hereby corrected as shown below:

On the title page:

Item *Primary Examiner* — change "Hwei C Payer" to --Hwei-Siu C Payer--

Signed and Sealed this
Nineteenth Day of July, 2016

Michelle K. Lee

Michelle K. Lee
*Director of the United States Patent and Trademark Office*